US005752283A

United States Patent [19]

Arens

[11] Patent Number: 5,752,283

[45] Date of Patent: May 19, 1998

[54] LOW COST PORTABLE PLAYYARD

[75] Inventor: Christopher Arens, Troy, Ohio

[73] Assignee: Lisco, Inc., Tampa, Fla.

[21] Appl. No.: 736,748

[22] Filed: Oct. 15, 1996

[51] Int. Cl.[6] ..... A47D 7/00

[52] U.S. Cl. ..... 5/99.1; 5/187; 5/98.1

[58] Field of Search ..... 5/98.1, 99.1, 98.3, 5/122, 186.1, 187

[56] References Cited

U.S. PATENT DOCUMENTS

| | | | |
|---|---|---|---|
| 2,345,295 | 3/1944 | Schettler, Jr. | 5/98.1 |
| 3,165,760 | 1/1965 | Abajian | 5/98.1 X |
| 4,538,309 | 9/1985 | Gunter | 5/99.1 |
| 4,921,369 | 5/1990 | Chew, II et al. | 5/99.1 X |
| 4,985,948 | 1/1991 | Mariol | 5/99.1 |
| 5,170,521 | 12/1992 | Light | 5/122 X |

*Primary Examiner*—Michael F. Trettel

[57] ABSTRACT

In a playyard of the type having a frame with an upper rail assembly positionable in a horizontal orientation, the frame also including a lower rail assembly positionable in a horizontal orientation beneath the upper rail assembly, the frame also including four vertically extending corner rails with fixed upper and lower corner brackets pivotally coupled to the upper rail assembly and to the lower rail assembly, the playyard also having vertical fabric panels between the upper and lower frame assembly and a horizontal floor panel coupled to the lower extent of the vertical fabric panels and a support for the lower floor panel including a plurality of straps stitched to the lower surface of the floor panel and secured with respect to the lower frame assembly.

4 Claims, 3 Drawing Sheets

FIG 1
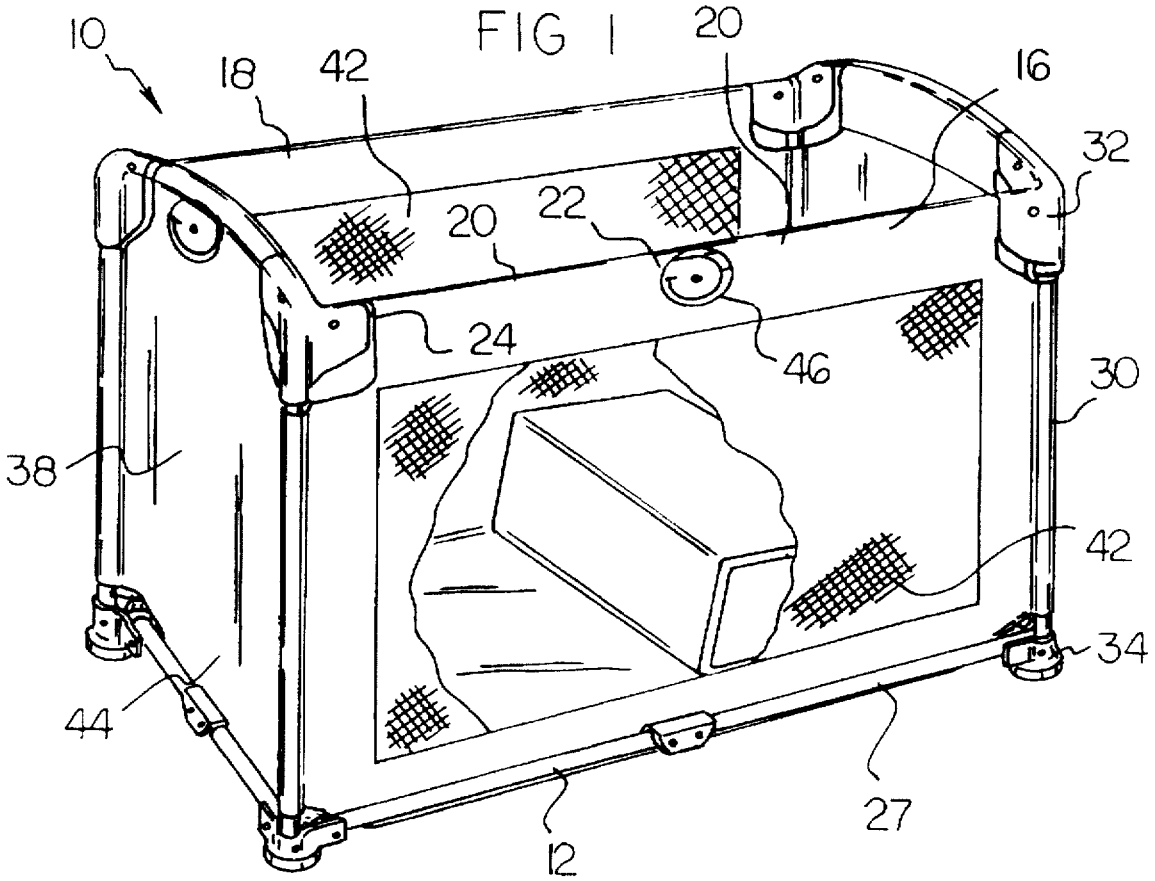
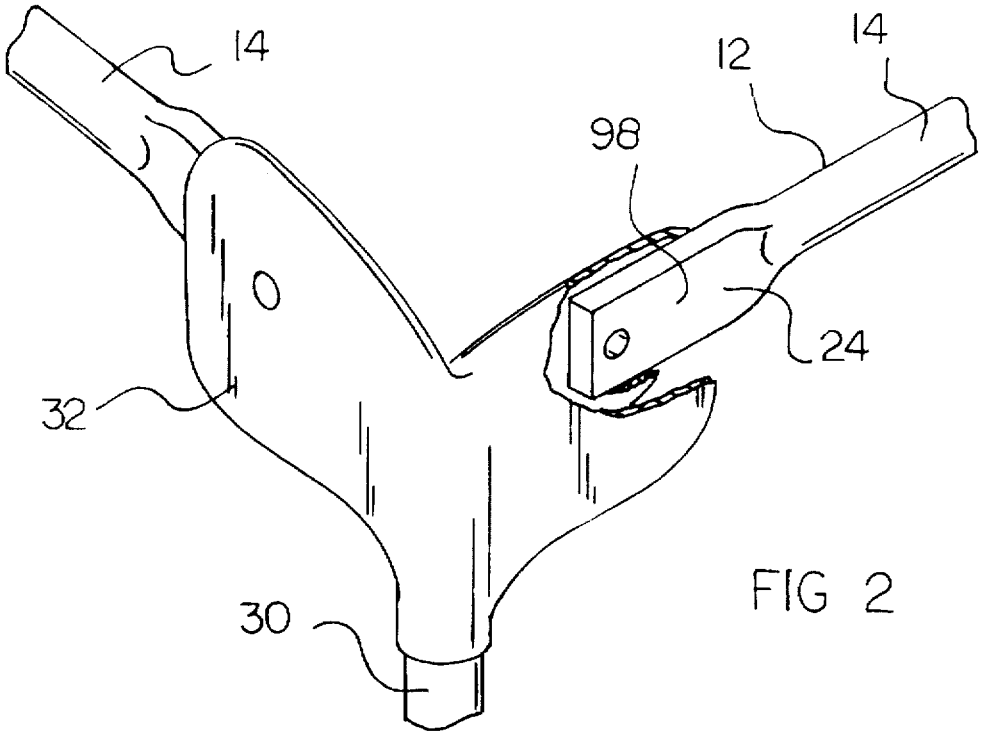
FIG 2

LOW COST PORTABLE PLAYYARD

BACKGROUND OF THE INVENTION

1. Field of the Invention

The present invention relates to a lightweight, collapsible portable playyard and, more particularly, to a playyard adapted to safely and conveniently convert between a deployed orientation and a collapsed orientation.

2. Description of the Prior Art

The use of playyards for receiving and supporting children is well known. Further, portable playyards with collapsible capabilities are also well known. Such portable collapsible playyards typically have an inconveniently large volume and weight whereby converting the playyard between an erect deployed orientation and a collapsed orientation for transportation and storage is a difficult task due to the unnecessarily large size and weight.

The patent literature discloses various types of playyards with collapsible capabilities. Note, for example, U.S. Pat. Nos. 4,811,437 to Dilner, 4,985,948 to Mariol and 2,486,054 to Morse.

None of these known playyards of the prior art provides the convenience attendant with the playyard of the present invention, the lightweight, collapsible portable playyard.

The present invention achieves its intended purposes, objects and advantages over the prior art through a new, useful and unobvious combination of components elements, through the use of a minimum number of functioning parts, at a reasonable cost to manufacture, and through the utilization of only readily available and conventional materials.

Therefore, the present invention relates to a new and improved playyard of the type having a frame with an upper rail assembly positionable in a horizontal orientation, the frame also including a lower rail assembly positionable in a horizontal orientation beneath the upper rail assembly, the frame also including four vertically extending corner rails with fixed upper and lower corner brackets pivotally coupled to the upper rail assembly and to the lower rail assembly, the playyard also having vertical fabric panels between the upper and lower frame assembly and a horizontal floor panel coupled to the lower extent of the vertical fabric panels; and a support for the lower floor panel including a plurality of straps stitched to the lower surface of the floor panel and secured with respect to the lower frame assembly.

Therefore, it is an object of this invention to provide a playyard which overcomes the inadequacies of the prior art devices and which constitutes an improvement which is a significant contribution to the advancement of the art.

Another object of the invention to reduce the weight of playyards to allow for the convenient deployment and collapse of a playyard with maximum safety.

It is another object of the present invention to maximize the safety of a playyard which may be easily and efficiently manufactured and marketed.

It is further object of the present invention to provide a playyard construction which is of a durable and reliable construction.

The foregoing has outlined some of the more pertinent objects of the present invention. These objects should be construed to be merely illustrative of some of the more prominent features and applications of the intended invention. Many other beneficial results could be obtained by applying the disclosed invention in a different manner or modifying the invention within the scope of the disclosure.

Accordingly, other objects and a fuller understanding of the invention may be had by referring to the summary of the invention and the detailed description of the preferred embodiment in addition to the scope of the invention as defined by the claims taken in conjunction with the accompanying drawings.

SUMMARY OF THE INVENTION

The invention is defined by the appended claims with the specific embodiment shown on the attached drawings. For the purposes of summarizing the invention, the invention essentially comprises a playyard of the type having a frame with an upper rail assembly positionable in a horizontal orientation when in a deployed orientation and formed of two side rails and two end rails with each being formed of two rail components pivotally coupled for movement between the deployed orientation and a collapsed orientation, the frame also including a lower rail assembly positionable in a horizontal orientation beneath the upper rail assembly when in a deployed orientation and formed of two side rails and two end rails with each being formed of two rail components pivotally coupled for movement between the deployed orientation and a collapsed orientation, the frame also including four vertically extending corner rails with fixed upper and lower corner brackets pivotally coupled to the upper rail assembly and to the lower rail assembly, the playyard also having vertical fabric panels between the upper and lower frame assembly and a horizontal floor panel coupled to the lower extent of the vertical fabric panels; and a support for the lower floor panel including the two straps in an X-shaped configuration stitched at central extents to the lower surface of the floor panel and with free ends secured to the lower corner brackets.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. Its should be appreciated by those skilled in the art that the conception and the disclosed specific embodiment may be readily utilized as a basis for modifying or designing other structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which;

FIG. 1 is perspective illustration of a low cost portable playyard constructed in accordance with the principles of the present invention.

FIG. 2 is an enlarged perspective showing of an upper corner bracket with a swedged upper rail.

DESCRIPTION OF THE PREFERRED EMBODIMENT

Figure 3:
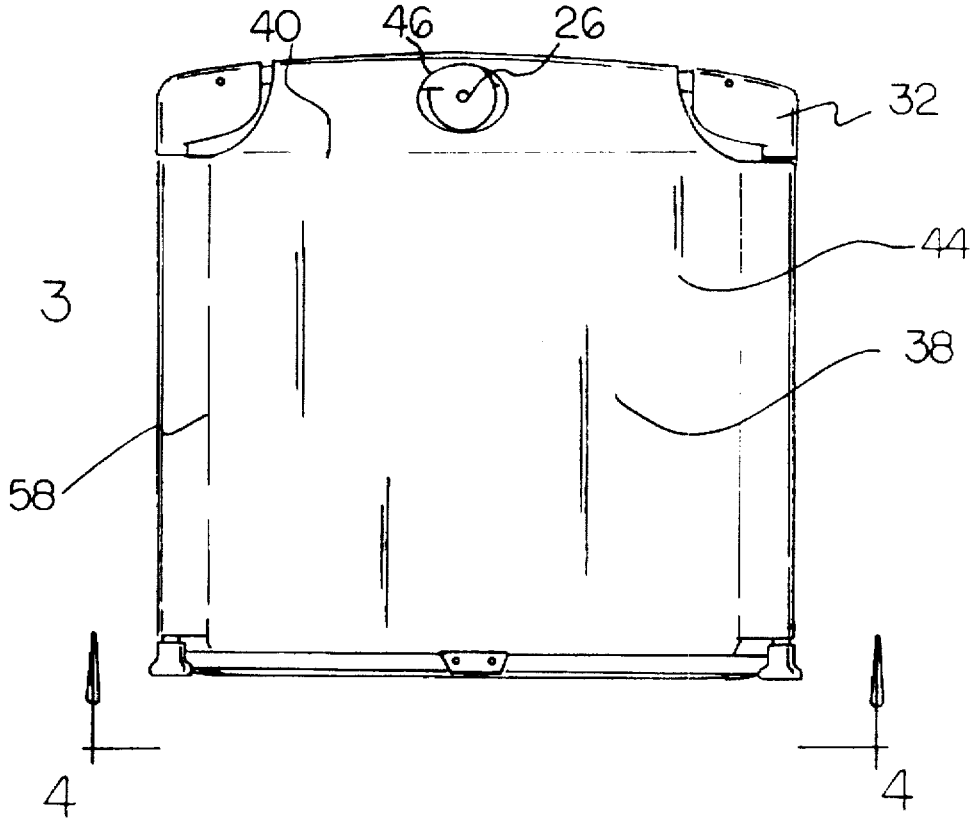
FIGS. 3 and 4 are a side and bottom elevational view of the playyard shown in FIG. 1.
Figure 4:
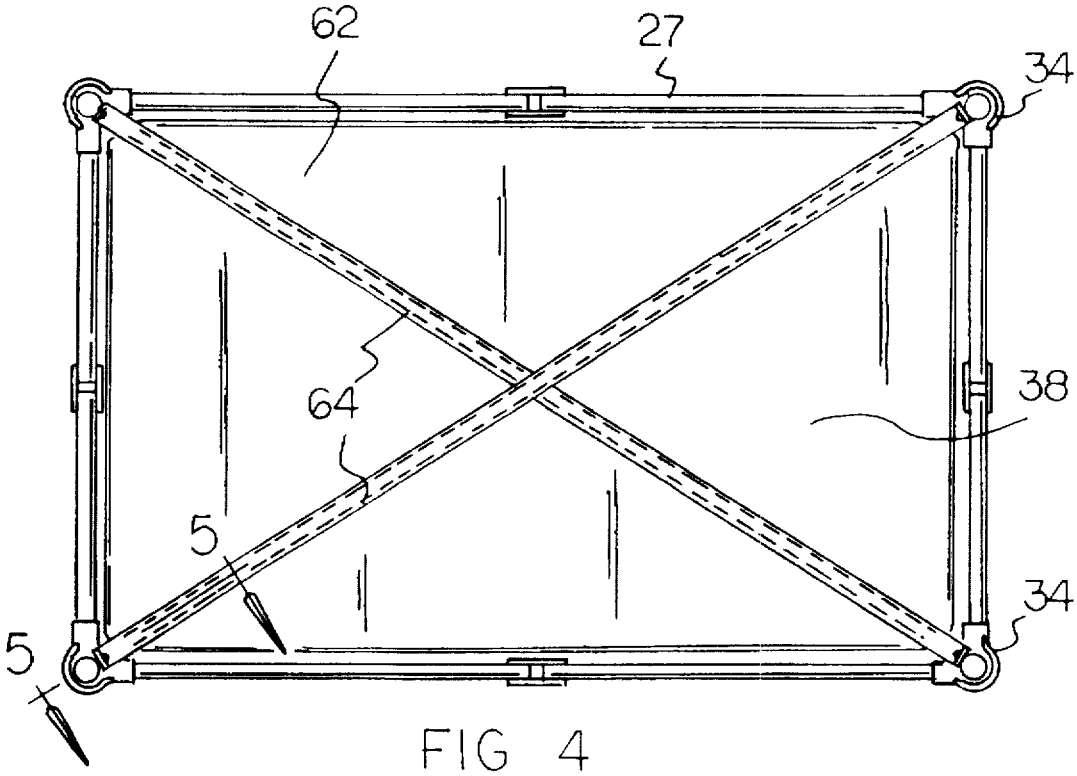
Figure 5:
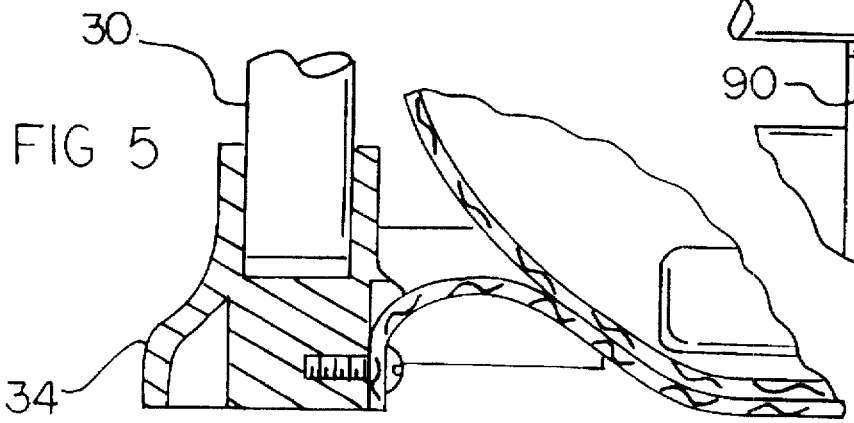
FIG. 5 is a cross-sectional view taken along line 55 of FIG. 4.

The present invention relates to a playyard with a improved playyard. In its broadest context, the present invention includes a collapsible frame structure with upper and lower frame assemblies and vertical corner rails to which fabric panels are secured. The upper and lower rail assemblies are composed of rail sections having interior ends safely but readily pivotable between a deployed and collapsed orientation. Vertical corner rails with corner brackets couple the upper and lower rail assemblies through fixed corner brackets.

More specifically, the present invention is a playyard 10. It is of a type having a supporting frame 12. The frame has an upper rectangular rail assembly 14. Such rail assembly is positionable in a horizontal orientation during operation and use as shown in FIG. 1. Such orientation of FIG. 1 is for when the playyard is in a open or deployed orientation. The frame assembly is provided with two longer side rails 16 and two shorter end rails 18. In an alternate embodiment, the rails may be of equal length to form a square configuration. Each of the rails, whether the side rails or the end rails, is formed to include two rail components 20. Each rail component has a interior end 22 and an exterior end 24.

The interior ends of the rails are pivotally coupled with respect to each other through a hinge assembly 26, preferably of the type disclosed in U.S. patent application Ser. No. 08/556,190, now U.S. Pat. No. 5, 644,800 filed Nov. 9, 1995.

The subject matter of such application is incorporated herein by reference. Such hinge allows movement between the deployed orientation as shown in FIG. 1 wherein the rails are horizontally disposed in a common plane with the rail components being in axial alignment one with respect to another and a collapsed orientation wherein the rails are all essentially disposed vertically and parallel with respect to each other.

The frame also includes a lower rail assembly 27. The lower rail assembly 27 is positionable in a horizontal orientation. Note FIG. 1. Such orientation is at a location beneath the upper rail assembly when it is deployed. Like the upper frame assembly, the lower frame assembly is formed of rail components coupled together by hinges as of the type disclosed in U.S. Pat. No. 4,985,948 to Mariol, the subject matter of which is incorporated herein by reference.

The frame also includes four vertically extending corner rails 30. Such rails are pivotally coupled at their upper ends to their upper rail assemblies and at their lower ends to the lower rail assemblies. Such pivotal coupling is through fixed corner brackets 32 and 34 fixedly secured to the vertical rails. Such fixed upper corner brackets 32 and lower corner brackets 34 allow for the pivotal coupling of the vertical rails to the horizontal rails in the conventional manner.

Support for the fabric panel assembly 38 is through a plurality of hems 40 at the upper extent of the side and end panels 42 and 44. Two such hems are along each edge with an opening 46 to allow access to the hinge 48. A flap may cover the hinge and is held in position by a pile type fastener and during operation and use as disclosed in the aformentioned patent to Mariol. The flap may be opened through separating the panel from the remainder of the hem to gain access to the hinge. The hinge may be operated with the fabric flap opened or closed.

In addition to the horizontal hems, a plurality of vertical hems 58 are also provided. Such hems extend outwardly from the vertical edges coupling the side and end panels and are four in number. Such vertical hems are unitary from top to bottom for encasing the vertical rails.

Also formed as part of the panel assembly is a lower or floor panel 62. Coupling between such floor panel and the lower portion of the frame is, in the preferred embodiment, achieved through a pair of straps 64 in an X-shaped configuration. Such straps are secured to the lower surface of the floor panel preferably through stitching. Each such strap has free ends coupled to the lower corner brackets 34 as by bolts for permanent couplings between the four ends of the two straps and the four lower corner brackets. The corner rails are of such height, and the straps are of such extent and positioning that during operation and use the floor panel rests upon a recipient surface such as a floor of a room in which the playyard is to be deployed.

The lower panel is preferably of a foam panel incased in a water impervious material such as nylon sheets with the edges coupled to make a permanent padding for the comfort of a child within the playyard.

An optional feature includes a rectangular support panel formed of four ridged segments with padding thereover and all encased by a water impervious sheet such as nylon with its edging sealed. Stitching is also provided in the three parallel, equally spaced lines between the floor ridged segments. Such support panel is positionable upon the floor panel during operation and use.

In the event of collapsing the playyard, the support panel of the alternate embodiment is removed and the center of the fabric floor panel is lifted through a loop provided for a user's convenience. The folding of all the central hinges allows the collapse of the playyard for transportation and storage. The support panel is then wrapped around the collapsed playyard for convenience of handling. Straps with a pile type fastener couple the adjacent ends of the support when in the collapsed orientation. Such is similar to that as disclosed in U.S. Pat. No. 4,811,437 to Dilner, the subject matter of which is incorporated herein by reference.

Figure 6A:
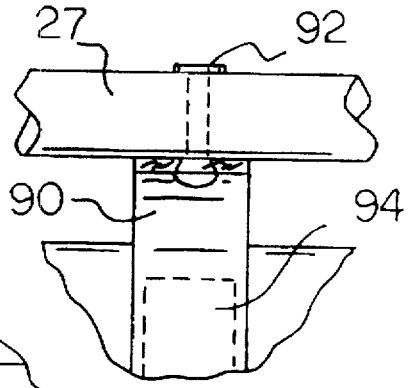
FIG. 6 is a bottom elevational view of an alternate embodiment of the invention The same reference numerals refer to the same parts through the various Figures.
Figure 6:
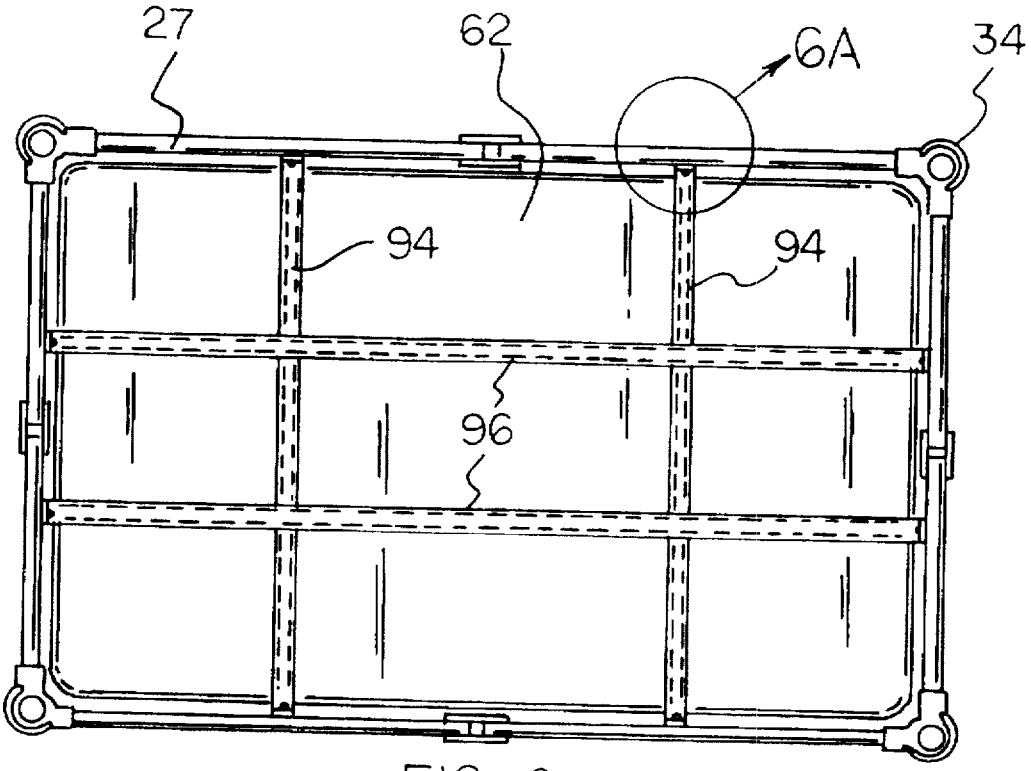

In a further alternate embodiment of the invention, the straps the support of the floor panel is constructed as shown in FIG. 6. In such embodiment, four straps are utilized. Each of the straps has two free ends 90 coupled to central sections of the lower frame assembly preferably by rivets 92. Two short straps 94 are parallel and are of a reduced length coupling the long rails on opposite sides of the associated hinge. Two long straps 96 are parallel and are of an extended length as compared to the short rails. Such straps 92 and 94 make a double cross configuration in a tic-tac-to design for increased support.

It should be understood, however, that although disclosed as a rectangular configuration and the primary embodiment, the configuration could readily be square.

Another feature of the present invention which adds to the compactness is the use of swedged tube ends 98 of a generally flattened configuration, rather than the more conventional round cross-sectional configuration at the exterior ends of the rail components in the upper rail assembly. This allows for corner brackets of reduced size. It also adds increased stability to the frame when assembled.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. In a playyard of the type having a frame with an upper rail assembly positionable in a horizontal orientation when in a deployed orientation and formed of two side rails and two end rails with each being formed of two rail components pivotally coupled for movement between the deployed orientation and a collapsed orientation, the frame also including a lower rail assembly positionable in a horizontal orientation beneath the upper rail assembly when in a deployed orientation and formed of two side rails and two end rails with each being formed of two rail components pivotally coupled for movement between the deployed orientation and a collapsed orientation, the frame also including four vertically extending corner rails with fixed upper and lower corner brackets pivotally coupled to the upper rail assembly and to the lower rail assembly, the playyard also having vertical fabric panels between the upper and lower frame assembly and a horizontal floor panel coupled to the lower extent of the vertical fabric panels;

a support for the lower floor panel including two straps in an X-shaped configuration stitched at central extents to the lower surface of the floor panel and with free ends secured to the lower corner brackets.

2. In a playyard of the type having a frame with an upper rail assembly positionable in a horizontal orientation, the frame also including a lower rail assembly, the frame also including four vertically extending corner rails with fixed upper and lower corner brackets pivotally coupled to the upper rail assembly and to the lower rail assembly, the playyard also having vertical fabric panels between the upper and lower frame assembly and a horizontal floor panel coupled to the lower extent of the vertical fabric panels;

a support for the lower floor panel including a plurality of straps stitched to the lower surface of the floor panel and secured with respect to the lower frame assembly the straps including two straps in an X-shaped configuration stitched at their central extents to the lower surface of the floor panel and with free ends looped through apertures in the lower corner brackets and stitched upon themselves for securement purposes.

3. In a playyard of the type having a frame with an upper rail assembly positionable in a horizontal orientation, the frame also including a lower rail assembly, the frame also including four vertically extending corner rails with fixed upper and lower corner brackets pivotally coupled to the upper rail assembly and to the lower rail assembly, the playyard also having vertical fabric panels between the upper and lower frame assembly and a horizontal floor panel coupled to the lower extent of the vertical fabric panels;

a support for the lower floor panel including a plurality of straps stitched to the lower surface of the floor panel and secured with respect to the lower frame assembly, the straps including four straps, two in parallel relationship having central extents stitched to the lower surface of the lower panel and having free ends riveted to opposite lower rails and two additional parallel straps stitched to the lower surface of the floor panel with free ends riveted to other opposite rails of the lower floor panel.

4. The playyard as set forth in claim 2 wherein the ends of the upper rail assemblies coupled to the upper corner brackets are swedged.

* * * * *